US005375310A

United States Patent [19]

Greifeneder et al.

[11] Patent Number: 5,375,310

[45] Date of Patent: Dec. 27, 1994

[54] METHOD OF DRAWING USING SINGULAR GODET ROLLERS

[75] Inventors: Karl Greifeneder; Kurt Truckenmüller, both of Heilbronn, Germany

[73] Assignee: Amann & Sohne GmbH & Co., Bonnigheim, Germany

[21] Appl. No.: 61,389

[22] Filed: May 11, 1993

[30] Foreign Application Priority Data

May 12, 1992 [DE] Germany ..... 4215015

[51] Int. Cl.[5] ..... D02G 1/16; D02J 1/22

[52] U.S. Cl. ..... 28/245; 28/207; 28/220

[58] Field of Search ..... 28/240, 245, 219, 220; 57/207

[56] References Cited

U.S. PATENT DOCUMENTS

| | | | |
|---|---|---|---|
| 3,539,680 | 11/1970 | Fukushima et al. | 264/290 |
| 3,781,953 | 1/1974 | Stegetman | 28/240 |
| 4,057,274 | 2/1978 | Kobayashi et al. | 28/245 X |
| 4,571,793 | 2/1986 | Price | 28/220 |
| 4,825,517 | 5/1989 | Hagler | 28/245 X |
| 5,083,419 | 1/1992 | Greifeneder et al. | 28/245 X |
| 5,136,763 | 8/1992 | Nugent | 28/245 |
| 5,146,738 | 9/1992 | Greifeneder et al. | 57/207 |

FOREIGN PATENT DOCUMENTS

| | | | |
|---|---|---|---|
| 0463635 | 1/1992 | European Pat. Off. . | |
| 1660481 | 8/1972 | Germany . | |
| 3436488 | 4/1985 | Germany | 28/240 |
| 3917338 | 11/1990 | Germany . | |
| 3264940 | 11/1988 | Japan | 28/240 |

*Primary Examiner*—Clifford D. Crowder
*Assistant Examiner*—John J. Calvert
*Attorney, Agent, or Firm*—Meltzer, Lippe, Goldstein, Wolf, Schlissel & Sazar

[57] ABSTRACT

A method is described of drawing a pre-oriented multifilament yarn (POY yarn). Hereby the multifilament yarn is fed from a delivery godet, around which it is wrapped, at a first velocity into a main drawing zone and removed from the main drawing zone at a second velocity by a drawing-off godet around which it is wrapped. The drawing in the main drawing zone takes place between the delivery godet and the drawing-off godet whereby the drawing-off godet is heated to a temperature of between 160° C. and 240° C. The first and the second velocities are so adjusted with respect to each other that the second velocity is 70% to 180% greater than the first velocity.

47 Claims, 1 Drawing Sheet

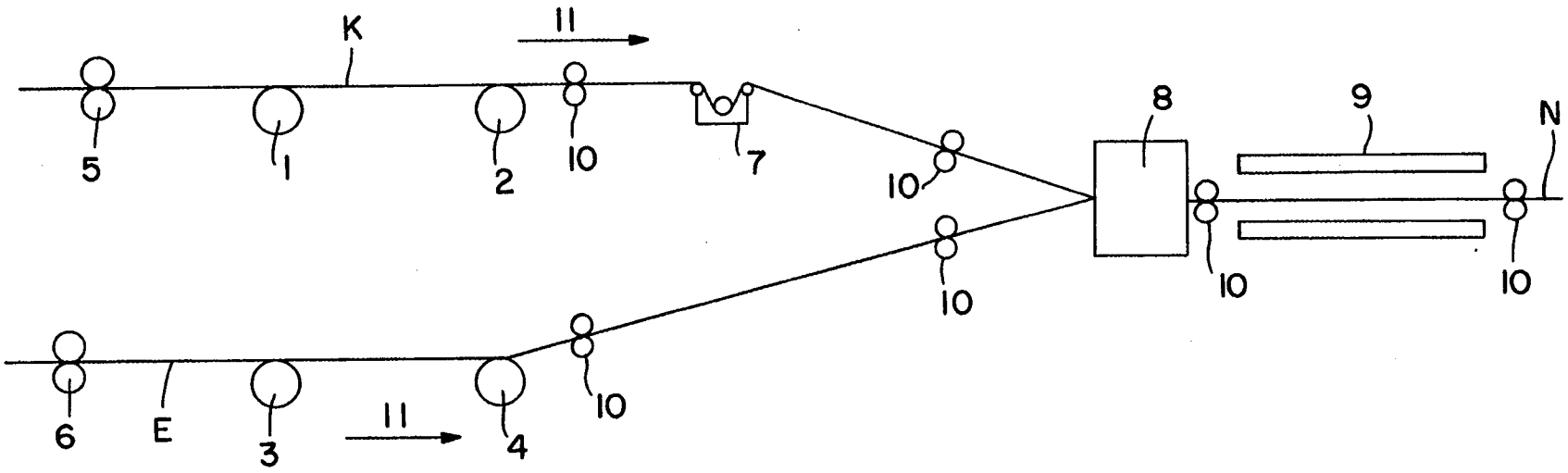
N
10
9
10
8
10
10
7
11
10
10
2
4
K
11
1
3
E
5
6

METHOD OF DRAWING USING SINGULAR GODET ROLLERS

The present invention is directed to a method of drawing a pre-oriented multifilament yarn (POY yarn) with the characteristics of the general definition in claim 1.

In order to draw pre-oriented multifilament yarns (POY yarn) it is known that the multifilament yarns are passed over a main drawing zone, whereby the main drawing zone is characterized by a delivery roller (godet) and a drawing-off roller (godet), The multifilament yarn is thereby wound round both the delivery roller (godet) and the drawing-off roller (godet) so that two grip points are produced, between which the multifilament yarn is drawn. Furthermore, a heated pin round which the yam is also wound is arranged in the known main drawing zone between the delivery roller (godet) and the drawing-off roller (godet). In order to bring about the desired drawing effect the multifilament yarn to be drawn is delivered to the main drawing zone at a first velocity and drawn off from the main drawing zone at a second velocity. Whereby, in the known device, the second velocity is up to about 60% higher than the first velocity, so that a corresponding tension is placed on the multifilament yarn. A further increase in the drawing-off velocity is not possible in the known device, Since otherwise there is undesirable breakage of individual filaments, that leads to permanent damage to the drawn multifilament yarn.

The purpose of the present invention is to make available a method for the drawing of multifilament yarns, which avoids filament breakage even at higher drawing-off velocities (second velocity).

This purpose is met according to the invention by a method with the characteristics laid down in claim 1.

In the method according to the invention for drawing a pro-oriented multifilament yarn (POY yarn), the multifilament yarn that is to be drawn is passed into the main drawing zone at a first velocity by a delivery roller (godet) round which the yarn is wound and removed from the main drawing zone at a second velocity by a drawing-off roller (godet) round which the yarn is wound. As in the present state of the art the second velocity is greater than the first velocity. The actual drawing takes place in the main drawing zone exclusively between the delivery roller (godet) and the drawing-off roller (godet), i.e., the heated drawing pin used in the present state of the art is not employed in the method according to the invention. In the method according to the invention the drawing-off roller (godet) is heated to a temperature of between 160° C. and 240° C. Whereby the first and second velocities are so adjusted with respect to each other that the second velocity is 70% to 180% greater than the first velocity. By this means the degree of drawing of the pre-oriented multifilament yarn that is to be drawn by the method according to the invention is 1:1.7 to 1:2.8.

Unexpectedly it was found that the POY yams, preferably polyester POY yarns. could be drawn very satisfactorily by the method according to the invention without filament breakage occurring at the aforementioned high degrees of drawing of 1:1.7 to 1:2.8. In the method according to the invention this is attributed to the omission of the heated drawing pin from the main drawing zone. Also multifilament yarns drawn in this manner exhibit relatively low shrinkage properties, particularly shrinkage on boiling (water 98° C.) of less than 1% and hot air shrinkage at 160° C. of less than 1.5%. Furthermore, it was established that multifilament yarns drawn by the method according to the invention possess a breaking strength that is between 20% and 80% greater than that which can be obtained by using the aforementioned conventional method with identical staffing materials.

A first and particularly suitable form of realization of the method according to the invention involves the first and second velocities being adjusted with respect to each other in such a manner that the second velocity is 100% to 160% greater than the first velocity. This means that this form of realization of the method according to the invention leads to degrees of drawing lying between 1:2 and 1:2.6. The multifilament yarns drawn in this manner, being preferably polyester multifilament yarns, are characterized by even lower shrinkage values, particularly boiling shrinkage (water 98° C.) of less than 0.8% and hot shrinkage (160° C.) of less than 1.2%. The breaking strengths of multifilament yarns drawn in this manner are also 60 to 80% higher than multifilament yarns drawn in the conventional manner.

A further form of realization of the method according to the invention also involves heating the delivery roller (godet) to a temperature of between 60° C. and 160° C., preferably to a temperature of between 80° C. and 140° C.

A further form of realization of the method according to the invention involves heating the multifilament yarn to be drawn in the main drawing zone, i.e. between the delivery roller (godet) and the drawing-off roller (godet), to a temperature of between 80° C. and 180° C. Whereby this heating in the main drawing zone of the multifilament yarn to be drawn is carried out in such a manner that in particular a hot plate, an IR radiator and/or a laser is used.

With regard to the time the multifilament yarn is heated and resides at the aforementioned temperatures (80° C. to 180° C.), in the main drawing zone, it is to be noted that this residence time in particular lies between 0.01 s and 1 s.

As already described, in the method according to the invention in order to provide the necessary gripping points in the main drawing zone, the multifilament yarn to be drawn is wound round the delivery roller (godet) and round the drawing-off roller (godet). Here it is found, in particular, that especially high breaking strengths and especially low shrinkages are obtained when the multifilament yarn to be drawn is wound 2–40 turns, preferably 5–10 turns round the delivery roller (godet) and/or the drawing-off roller (godet). These values for the numbers of turns apply to rollers (godets) with diameters ranging between about 40 mm to 250 mm, preferably 80 mm to 120 mm.

Another particularly suitable form of realization of the method according to the invention involves the arrangement of a predrawing zone before the main drawing zone in the direction of transport of the multifilament yarn that is to be drawn. In other words here the multifilament yarn (POY yarn) to be drawn is first partially drawn over the predrawing zone and then drawn to its final extent in the main drawing zone.

In the aforementioned variant of the method according to the invention it is appropriate to prodraw the multifilament yarn by between 0.5% and 10%, preferably by between 1% and 4% in the predrawing zone, i.e.

the multifilament yarn in stretched by between 0.5% and 10%, preferably by between 1% and 4%.

With respect to the velocities of predrawing and drawing it is found that the aforementioned high breaking strengths and low shrinkage levels are particularly economically and reproducibly achieved when velocities (drawing off velocities) greater than 300 m/min and preferably between 600 m/min and 1 200 m/min are chosen.

In order to obtain a particularly low-shrinkage and drawn yarn by the drawing method according to the invention another, particularly suitable form of realization of the method according to the invention involves a relaxation zone being placed after the main drawing zone in the direction of transport of the multifilament yarn, in which the drawn multifilament yarn is heated to a temperature of between 80° C. and 240° C., preferably to a temperature of between 140° C. and 200° C. Here it has been found that such a relaxation zone further reduces the aforementioned shrinkage level of the drawn multifilament yarn by about 20 to about 40%, particularly if the drawn multifilament yarn is fed into the relaxation zone with an overfeed, which preferably lies between 0.5% and 10% and especially between 1% and 3%. The residence time of the multifilament yarn in the relaxation zone varies between 0.01 s and 1 s depending on the velocity of transport of the yarn through the relaxation zone.

The choice of multifilament yarn (POY yarn) to be drawn by the method according to the invention depends on the use to which the drawn yarn is to be put later. For example, if the drawn yarn is later to be processed to a sewing thread, then it is advisable to choose as staring material a POY multifilament yarn, whose individual filament titre as starting material lies between 1 dtex and 12 dtex, preferably between 1.5 dtex and 4 dtex.

The total titre of the multifilament yam to be drawn also depends on the use to which the drawn yarn is to be put later. If the drawn yarn is later to be processed to a sewing thread then the total titre of the multifilament yarn to be drawn lies between 40 dtex and 2 000 dtex. Preferably between 80 dtex and 1 200 dtex.

If the multifilament yarn drawn by the method according to the invention is to be processed to a sewing thread, then a POY yarn is used having a number of elementary filaments of between 16 and 300, preferably of between 24 and 96.

A particularly suitable form of realization of the method according to the invention involves using as the pre-oriented multifilament yarn to be drawn a polyester POY yarn as it was already mentioned. Preferably a polyester POY yarn is used as starting material, whose intrinsic viscosity (IV) is between 0.5 d/g and 0.75 dl/g, preferably between 0.55 dl/g and 0.63 dl/g. Such a polyester POY yarn is a yarn, that corresponds in its molecular structure, in particular in its molecular weight and its chemical composition to a standard textile multifilament yarn. The aforementioned intrinsic viscosities correspond to those measured for appropriate solutions of the polymers in dichloroacetic acid at 25° C. Thus, the use of the method according to the invention allows conversion of a standard textile mutifilament yarn into a high-strength multifilament yarn, without, for example, having, as is the present state of the art, to resort to increasing the molecular weight of the polymers or to altering the monomers used for manufacturing the yarn.

As already described above, the method according to the invention can particularly find application in the manufacture of intermediate products for the production of sewing threads. Thus, for example, it is possible to twist two or more, preferably two to four, multifilament yarns drawn by the method according to the invention into a twisted sewing thread as it is described in the German patent application submitted on the same day as this by the applicant (Attorney's file 2036; official file number P 42 15 016.7). Furthermore, the multifilament yarn drawn by the method according to the invention can be processed into a core yarn as the core, whereby this core yarn itself or two to four core yarns can form a sewing thread, as it is described in detail in the German patent application submitted on the same day as this by the applicant (Attorney's file 2035; official file number P 42 15 212.7).

A particularly suitable further development of the aforementioned method according to the invention, which is especially suitable for the manufacture of sewing threads, involves intermingling the drawn multifilament yarn after drawing with at least one second multifilament yarn in a turbulent fluid flow, in particular in a gas flow, to yield a yarn with slings and loops. This form of realization of the method according to the invention yields in this manner an intermingled core-jacket yarn, whereby the core is the drawn multifilament yarn produced by the method according to the invention, while the jacket (effect material) is formed from at least one second multifilament yarn. Such a sewing thread which exists preferably of polyester multifilaments then exhibits as ready-made article strengths that preferably lie between 40 cN/tex and 60 cN/tex, whereby the residual shrinkage of the ready-made yarn is preferably less than 2% (thermal shrinkage at 160° C.) and less than 1.2% (boiling shrinkage water 98° C.). As it was possible to demonstrate in sewing experiments, such an intermingled sewing thread possesses excellent sewing properties, which are. for instance, expressed in that it does not break or cause other problems during sewing, during extremely difficult sewing operations. e.g. multidirectional sewing at up to 7000 stitches per minute or when sewing button holes. In addition, such a sewing thread can be excellently dyed with respect to colour tone and colour intensity, which is attributable to the fact that although this sewing thread contains a specially drawn multifilament yarn as core yarn, its molecular structure corresponds in other respects to that of a standard textile fibre.

In order to ensure that, in the aforementioned realization variant of the method according to the invention, the intermingled yarn that preferably finds application as sewing thread possesses a proper compactness, a further form of realization of the method according to the invention involves feeding the drawn multifilament yarn into the intermingling process at an overfeed of between 1% and 7% and the second, the multifilament yarn forming the effect material, at an overfeed of between 15 and 45%.

If, in addition, the drawn multifilament yarn is wetted with water or with an aqueous dispersion before intermingling this has the effect of making the core material and the effect material intermingled particularly intensively, which has the effect of increasing the fibre compactness of the manufactured core-jacket-yarn.

With respect to the titre and elementary filament number of the second multifilament yarn it should be noted that such a material should be chosen as,the second multifilament yarn in the method according to the invention that its titre is 15% to 40% and its elementary filament number is 30% to 250% of the titre and elementary filament number of the multifilament yarn making up the core (first yarn component) of the core-jacket yarn.

In order to improve the aforementioned dyeing behaviour of the intermingled core-jacket yarn a further realization form of the method according to the invention involves also using a pre-oriented multifilament yarn (POY yarn) as second multifilament yarn. This pro-oriented multifilament yarn. Which, like the drawn multifilament yarn used as core, also consists of polyester, can be drawn, either by the normal state of the art method described initially, or preferably also drawn as described in detail for the various aforementioned realization forms of the method according to the invention. In concrete terms this means that the multifilament effect material then in the simplest case is drawn in the already described main drawing zone between the delivery roller (godet) and the drawing off roller (godet) of the method according to the invention, without a drawing pin being incorporated in this main drawing zone. Furthermore, for the purpose of drawing the multifilament effect material the drawing-off roller (godet) is heated to a temperature of between 160° C. and 240° C., whereby the first velocity (delivery speed) and the second velocity are so adjusted with respect to each other that the second velocity is 70% to 180% greater than the first velocity.

It is also possible to draw the second multifilament yarn (effect yarn) in such a manner that the second velocity is between 100% and 160% greater than the first velocity.

The variants of the method according to the invention described initially referring to the temperature range of the delivery roller (godet), to the heating of the multifilament yarn in the main drawing zone, to the heating time, to the winding around the delivery roller (godet) and/or the drawing-off roller (godet), to the arrangement of the predrawing zone, to the overfeed in the predrawing zone, to the drawing velocity, to the arrangement of the relaxation zone, to the overfeed in the relaxation zone and to the choice of intrinsic viscosity of the yarn processed, can also be applied in an identical manner to drawing of the second multifilament yarn (effect yarn), thus making it possible to avoid repetition by referring to the realization variants previously described.

In one suitable realization form of the method according to the invention the multifilament yarn forming the core of the core-jacket yarn and the multifilament yarn forming the jacket of the core-jacket yarn are identically drawn so that the intermingled core-jacket yarn produced accordingly is particularly characterized by uniform dyeing with respect to colour tone and colour density.

A further and particularly suitable realization form of the method according to the invention involves the intermingling of 1 to 4 multifilament yarns drawn according to the initially described drawing process, which form the core of the intermingled core-jacket yarn, with 1 to 4 multifilament yarns or yarns making up the jacket component of the intermingled core-jacket yarn. This results in the production of core-jacket yarns that are characterized by extremely high strength and that are particularly used as sewing threads, whereby such sewing threads exist preferably of polyester multifilaments.

In order to increase the compactness of the intermingled core-jacket yarn, a further development of the aforementioned method variant involves twisting the intermingled core-jacket yarn with between 10 turns per metre and 1 000 turns per metre, preferably between 100 turns per metre and 600 turns per metre after it has been intermingled.

In order to improve the aforementioned compactness of the intermingled core-jacket yarn, a further realization variant of the method according to the invention involves subjecting the intermingled core-jacket yarn to a tensioning treatment so that the interlacing loops and slings produced on intermingling are reduced by about 20% to 95% with respect to their original diameters. This reduces the volume of the intermingled yarn correspondingly so that such a yarn exhibits a reduced number of projecting slings and loops, so that tangling of these slings and loops is prevented during processing and particularly on the employment of such a yarn as sewing thread.

In order to carry out the aforementioned tensioning treatment the intermingled core-jacket yarn is delivered to the tensioning treatment at a velocity that is between 0.1% and 5%, preferably between 0.1% and 2.5% less than the velocity at which the yarn is taken up from the tensioning treatment.

The aforementioned reduction of the diameter of the slings and loops of the intermingled yarn can also be achieved by subjecting the intermingled core-jacket yarn to a thermal treatment at a temperature of between 100° C. and 250° C., in particular between 180° C. and 240° C. Hence, this thermal treatment is preferably carried out in a stream of hot air, whereby the duration of the thermal treatment lies in particular between 0.01 s and 10 s, preferably between 0.05 s and 1 s. Such a thermal treatment simultaneously serves to reduce the shrinkage (boiling shrinkage —water, hot air shrinkage) of the intermingled core-jacket yarn.

In order also to achieve a relaxation of the intermingled core-jacket yarn during the aforementioned thermal treatment another realization form of the method according to the invention involves delivering the intermingled yarn to the thermal treatment at a velocity that is greater than the velocity at which the core-jacket yarn is taken up from the thermal treatment. The core-jacket yarn is preferably fed into the thermal treatment at a velocity which is 0.5% to 10%, particularly 1% to 3% higher than the drawing-off velocity of the core-jacket yarn from the thermal treatment. So that the core-jacket yarn is free to shrink during the thermal treatment, which also has a very positive effect on the residual shrinkage of core-jacket yarn that is so treated.

Particularly good results, with respect to sewing properties, are exhibited by a core-jacket yarn manufactured by the method according to the invention whose hairiness lies between 3 and 6.5 and particularly between 4and 5. Whereby these hairiness values are based on measurement results obtained by the known method using an Uster yarn uniformity measuring apparatus. Type UT3.

As it has already been mentioned previously in several places polyester multifilaments are preferably processed by the method according to the invention, whereby polyester is understood, for the purpose of the present application, to be polyethylene terephthalate.

Advantageous-further realizations of the method according to the invention are given in the subclaims.

The method according to the invention is explained further on the basis of an example in combination with a drawing (FIG. 1 ).

A polyester POY yarn labelled K, having an initial titre of 410 dtex and a filament number of 40 is drawn in a device illustrated schematically in FIG. 1. Hereby the device is equipped with a main drawing zone between a delivery godet 1 and a drawing-off godet 2. The multifilament yarn K is wound 20 times round both delivery godet 1 and drawing-off godet 2. The delivery velocity of yarn K to the delivery godet and the drawing-off velocity of yarn K from the drawing-off godet 2 were so adjusted with respect to each other that the POY yarn K was drawn to a draw-ratio of 1:2.35 in the main drawing zone. Prior to the main drawing zone made up of godets 1 and 2, there was a predrawing zone located, comprising delivery work 5 and drawing-off godet 1. Here the velocity of the delivery work 5 was adjusted to the velocity of the drawing-off godet 2 in such a manner that the POY yarn K was stretched by 5% in the predrawing zone, A second yarn E was, like yarn K, led from a cone which is not shown to a delivery work 6. The yarn was then transported to a delivery godet 3 and from there it was drawn onto a drawing-off godet 4. Delivery godet 3 and drawing-off godet 4 formed the main drawing zone for the polyester POY yarn E. Whereby the velocities of these two godets (3 and 4) were so adjusted with respect to each other that a degree of drawing of 1:2.0 was obtained in the main drawing zone for the POY yarn E. Prior to the main drawing zone a predrawing zone was arranged comprising delivery work 6 and delivery godet 3. Yam E was predrawn by 5% in this predrawing zone. Yarn E was a polyester POY yarn with a titre of 131 dtex and a filament number of 24.

Godets 1 and 3 Were heated to a temperature of 90° C. The temperature of godets 2 and 4 was 200° C. Yarn E was also wrapped 20 times round godets 3 and 4.

The velocity when drawing was 800 m/min.

The diameters of godets 1 to 4 is 150 mm.

After leaving the drawing-off godet yarn K was wetted with water by wetting device 7, travelled from there in arrow direction 11 into the nozzle 8, while yarn E was fed directly into nozzle 8 without wetting (in arrow direction 11 ). The overfeed of yarn K was 5%, while the overfeed of yarn E was 18%.

Yarns K and E were intermingled with each other in the nozzle 8. To the exit of the nozzle 8 was fitted a heating tube 9, in which the core-jacket yarn composed of yarn K in the core and yarn E in the jacket was heated to a temperature of 240° C. The overfeed on passing into the heating apparatus 9 was 2%. The length of the heating apparatus was 2 m whereby the intermingled core-jacket yarn was transported through the heating apparatus 9 at a velocity of 800 m/min. The intermingled core-jacket yarn N was wound on at the exit to heating apparatus 9.

The sewing thread so produced was dyed and a yarn preparation was applied conventionally. Afterwards the sewing thread was characterized by a boiling shrinkage (water 98° C.) of 0.8% and a hot air shrinkage (160° C.) of 1%. The specific strength of the sewing thread was 42 cN/tex.

Transport devices are designated in the schematic diagram with 10.

The sewing thread so produced was subjected to industrial sewing operations. In particular investigations were made of multidirectional sewing at a stitching rate of 7000 stitches per minute and of the properties when stitching button holes. Whereby it was discovered that the sewing thread produced according to the aforementioned method did not differ in its sewing properties from an analogously structured material employing high-strength polyester multifilament yarns as core and effect materials, i.e. such yarns as were characterized by an appreciably higher molecular weight.

The sewing threads produced according to the aforementioned method were subjected to dyeing trials with various combinations of dyestuffs, The aforementioned conventional sewing threads with jacket and core composed of high-strength polyester multifilament yarns were also dyed.

The dyeing conditions were as follows:

| | |
|---|---|
| Starting temperature | 70° |
| Heating rate to | 130° C.-2° C./min |
| Residence time at 130° C. | 45 minutes |
| Cooling to | 80° C. at 2° C./min |

After being dyed the yarns were rinsed twice cold and hot and then dried conventionally. The dye liquors were all adjusted to pH 4.5 by the addition of acetic acid and sodium acetate. Furthermore, all dye liquors contain 0.5 g/l of a dispersing/levelling agent (Levegal HTN, Bayer). The following dye combinations were used:

| | |
|---|---|
| | Dye combination I: |
| 0.5% | Resolinyellowbrown 3 GL, 200% (C.I. Disperse orange 29) |
| 0.25 | Resolinred FB, 200% (C.I. Disperse red 60) |
| 1% | Resolinnavyblue 2 GLS, 200% (C.I. Disperse blue 79) |
| | Dye combination II: |
| 3% | Resolinnavyblue 2 GLS, 200% (C.I. Disperse blue 79) |
| 0.15% | Resolinyellow 5 GL, 200% |
| 0.8% | Resolinred BBL, 200% |
| | Dye combination III: |
| 0.5% | Resolinblue BBLS, 200% (C.I. Disperse blue 165) |
| 1.5% | Resolinyellowbrown 3 GL, 200% (C.I. Disperse orange 29) |
| 0.5% | Resolinred FB, 200% (C.I. Disperse red 60) |
| | Dye combination IV: |
| 0.1215% | Resolinorange R-3GLS |
| 0.0265% | Resolinred R-2BLS |
| 0.0275% | Palanilbrilliantblue BGF |
| 0.024% | Resolinblue R-RLS |

The results of the dyeing trials revealed that the sewing thread produced according to the aforementioned method did not exhibit any differences (colour tone, colour depth) between the core material and the jacket material, while, particularly when dyed with dye. combinations II and III, the conventionally produced comparison material exhibited appreciable differences in colour tone and colour depth between the core material and jacket material.

We claim:

1. A method of drawing a pre-oriented multifilament yarn, POY-yarn, comprising passing the multifilament yarn via a singular delivery godet roll, around which the yarn is wound, at a first velocity into a main drawing zone, and removing the multifilament yarn from the main drawing zone at a second velocity via a singular drawing-off godet roll, around which the yarn is wound, whereby said second velocity is 70% to 180% higher than said first velocity, and said drawing occurs only in said main drawing zone between said delivery godet roll and said drawing-off godet roll, and said drawing-off godet roll is kept at a temperature between 160° C. and 240° C., wherein said delivery godet roll is heated to a temperature between 60° C. and 160° C., said POY yarn to be drawn is a polyester POY yarn and the intrinsic viscosity of said yarn lies between 0.5 dl/g and 0.75 dl/g.

2. The method according to claim 1, wherein said first and second velocities are so adjusted with respect to each other that said second velocity is between 100% and 160% higher than said first velocity.

3. The method according to claim 1, wherein said multifilament yarn to be drawn is heated in said main drawing zone to a temperature of between 80° C. and 180° C.

4. The method according to claim 3, wherein a hot plate, an IR ratiator a laser is used in the main drawing zone to heat said multifilament yarn.

5. The method according to claim 3, wherein said multifilament yarn is heated in said main drawing zone for between 0.01 s and 1 s.

6. The method according to claim 1, wherein said multifilament yarn to be drawn is wound 2 to 40 times round said delivery godet roll or said drawing-off godet roll.

7. The method according to claim 1 wherein in the direction of travel of said yarn, the multifilament yarn to be drawn passes over a predrawing zone before it arrives at the main drawing zone.

8. The method according to claim 7, wherein said multifilament yarn is predrawning between 0.5% and 10% and in said predrawing zone.

9. The method according to claim 1, wherein said predrawing or said drawing are carried out at a drawing off velocity greater than 300 m/min.

10. The method according to claim 1, whereby a relaxation zone is placed after said main drawing zone in the direction of transport of said drawn multifilament yarn, in which said drawn multifilament yarn is heated to a temperature of between 80° C. and 240° C.

11. The method according to claim 10, wherein said drawn multifilament yarn is delivered to said relaxation zone with an overfeed.

12. The method according to claim 11, wherein said drawn multifilament yarn is fed into said relaxation zone with an overfeed of between 0.5% and 10%,

13. The method according to claim 1 whereby a yarn chosen as said pre-oriented multifilament yarn (POY yarn) has a filament titre of between 1 dtex and 12 dtex.

14. The method according to claim 1 wherein said POY yarn to be drawn has a total yarn titre of between 40 dtex and 2,000 dtex.

15. The method according to claim 1, wherein said POY yarn to be drawn is a polyester POY yarn and the intrinsic viscosity (IV) of said yarn lies between 0.5 dl/g and 0.75 dl/g.

16. The method according to claim 1, wherein said drawn multifilament yarn is intermingled in a turbulent fluid stream, with at least one second multifilament yarn to form a core-jacket yarn with slings and loops, whereby said intermingling is carried out in such a manner that said drawn multifilament yarn forms the inner core and said second multifilament yarn the jacket surrounding said core,

17. The method according to claim 16 wherein said drawn multifilament yarn is led to said intermingling with an overfeed of between 1% and 7% and said second multifilament yarn is led to said intermingling with an overfeed of between 15% and 45%.

18. The method according to claim 16, wherein said drawn multifilament yarn is wetted with water or an aqueous dispersion before being intermingled.

19. The method according to claim 16, wherein a pre-oriented multifilament yarn (POY yarn), that has been drawn before being intermingled, is used as second multifilament yarn.

20. The method according to claim 19, wherein a multifilament yarn, whose titre is 15% to 40% and whose number of elementary filaments is 30% to 250% each with respect to the titre and to the number of filaments of the core of the core-jacket multifilament yarn, is chosen as second multifilament yarn.

21. The method according to claim 20, wherein said second multifilament yarn is drawn off in the drawing process at a velocity which is 70% to 180% higher, than the delivery velocity.

22. The method according to claim 16, wherein 1 to 4 multifilament core yarns and 1 to 4 multifilament effect yarns are intermingled.

23. The method according to claim 16, wherein said intermingled core-jacket yarn is twisted between 10 turns per metre and 1,000 turns per metre.

24. The method according to claim 16, wherein said intermingled core-jacket yarn is dyed applied with a yarn preparation after said intermingling process.

25. The method according to claim 16, wherein said intermingled core-jacket yarn is subjected to a tensioning treatment such that the interlacing slings and loops formed by intermingling are so reduced in size that their diameter is reduced by about 20% to about 95%, with respect to their original diameter.

26. The method according to claim 25, wherein said intermingled core-jacket yarn is fed to said tensioning treatment at a velocity that is between 0.1% and 5%, less than the velocity at which the yarn is drawn off from said tensioning treatment.

27. The method according to claim 16, wherein said intermingled core-jacket yarn is subjected to a thermal treatment at a temperature of between 100° C. and 250° C., before being taken up.

28. The method according to claim 27, wherein said thermal treatment is carried out in a stream of hot air.

29. The method according to claim 27, wherein said thermal treatment is carried out for between 0.01 s and 10 s.

30. The method according to claim 27, wherein said intermingled core-jacket yarn is delivered to said thermal treatment at a velocity that is the same or higher than the velocity at which the yarn is taken up from said thermal treatment.

31. The method according to claim 1, wherein said method is used to manufacture a sewing thread.

32. The method of claim 1 wherein said delivery godet roll is heated to a temperature to between 80° C. and 140° C.

33. The method of claim 1 wherein the intrinsic viscosity of said yarn lies between 0.55 and 0.63 dl/g.

34. The method of claim 1 wherein said mutlifilament yarn to be drawn is wound 5 to 10 times round said delivery godet roll or said drawing-off godet roll.

35. The method according to claim 8 wherein said multifilament yarn is pre-drawn between 1% and 4% in said predrawing zone.

36. The method of claim 9 wherein said pre-drawing drawing is carried out at a drawing off velocity between 600 m/min and 1,200 m/min.

37. The method of claim 10 wherein said drawn multifilament yarn is heated to a temperature between 140° C. and 200° C.

38. The method of claim 12 wherein said drawn multifilament yarn is fed into said relaxation zone with an overfeed of between 1% and 3%.

39. The method according to claim 13 wherein said yarn chosen as said pre-oriented multifilament yarn has a filament titer between 3 dtex and 8 dtex.

40. The method according to claim 14 wherein said POY-yarn to be drawn has a total yarn titre of between 80 dtex and 1,200 dtex.

41. The method according to claim 15 wherein said POY-yarn to be drawn is a polyester POY-yarn and the intrinsic viscosity of said yarn lies between 0.55 dl/g and 0.63 dl/g.

42. The method according to claim 16 wherein said fluid stream is a gas stream.

43. The method of claim 21 wherein said second multifilament yarn is drawn off in a drawing process at a velocity which is 100% to 160% higher than the delivery velocity.

44. The method of claim 23 wherein said intermingled core-jacket yarn is twisted between 100 turns per meter and 600 turns per meter.

45. The method according to claim 26 wherein said intermingled core-jacket yarn is fed to said tensioning treatment at a velocity that is between 0.1% and 2.5% less than the velocity at which the yarn is drawn off from said tensioning treatment.

46. The method according to claim 27 wherein said intermingled core-jacket yarn is subjected to a thermal treatment at a temperature of between 180° C. and 240° C. before being taken up.

47. The method according to claim 25 wherein said thermal treatment is carried out for between 0.05 s and 1 s.

* * * * *